US006447034B1

(12) United States Patent
Cummings

(10) Patent No.: US 6,447,034 B1
(45) Date of Patent: Sep. 10, 2002

(54) SOAP RETRIEVER FOR SHOWER

(76) Inventor: Joe Cummings, 504 Cummings Ave., Pocola, OK (US) 74902

( * ) Notice: Subject to any disclaimer, the term of this patent is extended or adjusted under 35 U.S.C. 154(b) by 0 days.

(21) Appl. No.: 09/875,214

(22) Filed: Jun. 7, 2001

(51) Int. Cl.[7] ..... B25J 1/04
(52) U.S. Cl. ..... 294/19.1; 294/55
(58) Field of Search ..... 294/1.1, 1.3, 1.4, 294/19.1, 19.2, 22, 24, 49, 51, 55, 57; 15/257.1–257.7; 30/324, 325, 327; 209/418, 419; 210/470; 401/88; D8/10; D7/691, 692; D30/162; D32/35

(56) References Cited

U.S. PATENT DOCUMENTS

| | | | | | |
|---|---|---|---|---|---|
| 768,871 | A | * | 8/1904 | Albertson | 15/257.3 |
| 2,141,007 | A | * | 12/1938 | Meeh | 294/55 |
| 2,283,669 | A | * | 5/1942 | Edgren et al. | 294/55 X |
| D148,911 | S | * | 3/1948 | Comeau | D7/691 |
| 2,795,119 | A | * | 6/1957 | Bair | 30/325 |
| 2,987,749 | A | * | 6/1961 | Gortner | 15/257.7 |
| 3,226,149 | A | * | 12/1965 | McJohnson | 294/51 X |
| 4,005,892 | A | | 2/1977 | Williams | 294/1.4 |
| 4,136,902 | A | * | 1/1979 | Leonard | 294/55 X |
| 4,155,580 | A | | 5/1979 | Moller | 294/1.1 |
| 4,627,128 | A | * | 12/1986 | Shea | 294/55 X |
| D368,997 | S | | 4/1996 | Tucker | D32/35 |
| D391,131 | S | * | 2/1998 | Lehn et al. | 294/55 |
| D406,415 | S | * | 3/1999 | Martin | D30/162 |

FOREIGN PATENT DOCUMENTS

| | | | | |
|---|---|---|---|---|
| GB | 9868 | * | 10/1914 | 294/55 |

* cited by examiner

*Primary Examiner*—Johnny D. Cherry
(74) *Attorney, Agent, or Firm*—William S. Dorman

(57) ABSTRACT

A soap retriever for use in a shower stall comprising an elongated shaft having an upper end and a lower end, a downwardly concave hook attached to the upper end of the retriever for hanging the soap retriever in the shower stall when not in use, a soap receiving compartment mounted at the lower end of the soap retriever, the soap compartment including a pair of vertically spaced horizontal plates, the horizontal plates consisting of an upper horizontal plate and a lower horizontal plate, the two plates extending divergently outwardly from the shaft and forming therebetween the compartment for receiving a bar of soap therein. In one embodiment of the soap retriever, the shaft is comprised of a pair of relatively telescopic members which permit the shaft to be shortened or lengthened.

1 Claim, 3 Drawing Sheets

SOAP RETRIEVER FOR SHOWER

BACKGROUND OF THE INVENTION

1. Field of the Invention

The present invention relates to a soap retriever and more particularly to a soap retriever which can be employed in a shower stall.

2. Prior Art

The soap retriever of the present invention, as will appear hereinafter, serves a very practical and useful function in the bathroom, mainly because this accessory is a health conscious item, reducing serious bathtub and shower injuries which frequently occur in these places.

Injuries occur in the bathtub and in the shower stall because of limited range of movement while standing and taking a shower. The soap retriever will greatly reduce the risk of slipping and seriously injuring oneself. This item will be ideal for the elderly and for all people who have problems with restricted movement due to existing long or short term injuries.

Nothing is more frustrating and irritating than dropping your soap while taking a shower, especially while in a small shower stall. It is nearly impossible to retrieve the soap without getting out of the shower itself, and, at times, the soap is hard to grasp. By using the device of the present invention, one can easily retrieve his/her soap quickly and conveniently without bending over. Since there is very little space to maneuver in a shower stall, the device of the present invention will be very useful for pregnant woman, tall people, handicapped people and/or obese people.

A preliminary search was conducted on the present invention and the following listed United States Patents were uncovered:

| Inventor | U.S. Pat. No. | Date |
|---|---|---|
| Epperson | 936,990 | October 12, 1909 |
| Meeh | 2,141,007 | December 20, 1938 |
| Blum | 3,406,663 | July 22, 1969 |
| Williams | 4,005,892 | February 1, 1977 |
| Moller | 4,155,580 | May 22, 1979 |
| Flood | 5,033,781 | July 23, 1991 |
| Vachter | 5,360,247 | November 1, 1994 |
| Schmieler | D234,304 | February 11, 1975 |
| Kline | D283,262 | April 1, 1986 |
| Elrod | D316,315 | April 16, 1991 |
| Tucker | D368,997 | April 16, 1996 |
| Martin | D406,415 | March 2, 1999 |
| Nunes | D409,804 | May 11, 1999 |

None of the above patents discloses a device which can be used to pick up or retrieve a bar of soap in a shower stall or in the bathtub. Moller, U.S. Pat. No. 4,155,580, shows a scoop that can be attached to the foot of the person taking the shower for the purpose of retrieving the soap. However, after retrieving the soap, the person would have to lift his foot to a position where the soap could be retrieved by the hand from the elevated foot; this obviously would be very awkward for a normal person and impossible for people having infirmities.

Tucker, U.S. Pat. No. D 368,997, shows a scoop for soap which consists essentially of a trough-shaped member with a handle at one end. It is not understood how this device could be used in a confined area. The person taking the shower would still have to bend over to use this scoop, a feat which would be difficult for the handicapped.

SUMMARY OF THE INVENTION

A soap retriever is provided for use in a shower stall or in a bath tub by any person taking a shower who is faced with the prospect of attempting to retrieve a bar of soap which has unhappily fallen to the floor of the stall or tub. The soap retriever consists of a shaft, which could be referred to a cane shaft, and a hook (or crook) at the upper end of the shaft. The hook is downwardly concave. A soap compartment which extends out horizontally from the bottom of the retriever is attached to the lower end of the cane shaft. If desired, the cane shaft can be comprised of two or more tubular elements which are relatively telescopically arranged within one another so as to vary the length of the cane shaft. The cane shaft is preferably made from a light weight metal, such as aluminum, or it could be made out of plastic material.

The soap compartment includes a pair of flat horizontal plates vertically spaced from each other and extending out divergently, or fan-like, from the base of the cane shaft. The forward edge of the lower plate is preferably flat and can be somewhat tapered. The upper plate, however, can be curved along the forward edge and can be scalloped to provide an attractive appearance. The vertical distance between the two plates is relatively greater than the thickness of a conventional bar of soap. In use, the person taking a shower will remove the soap retriever from the shower curtain rod and grasp the cane shaft at the upper end thereof or even grasp the curved hook and then retrieve the soap by maneuvering the soap compartment against the bar of soap. Thereafter, the shaft is raised to a position where the soap can be removed from the soap compartment and the device can be hooked over the shower curtain rod.

DETAILED DESCRIPTION OF THE PREFERRED EMBODIMENTS

Figure 1:
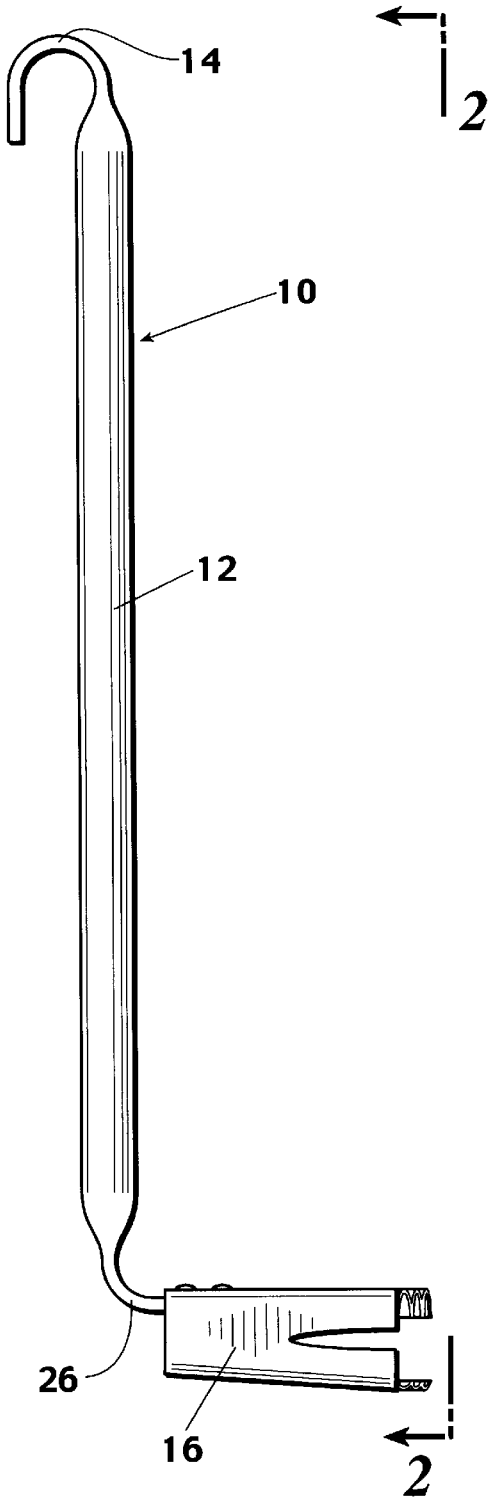
FIG. 1 is a side elevation of a soap retriever constructed in accordance with one embodiment of the present invention.

Referring to the drawings in detail, FIG. 1 shows soap retriever 10 consisting of a cane shaft 12 which is provided with a hook 14 at the upper end and a soap compartment 16 at the lower end. The shaft 10 is preferably tubular and can be made of plastic or light-weight metal. The hook 14, which looks somewhat like a crook, is curved and downwardly concave so as to permit the device 10 to be hooked over a rod (not shown) which holds the shower curtain (not shown). The device will remain hooked over the rod until it becomes necessary to use the device to retrieve a bar of soap.

Figure 3:
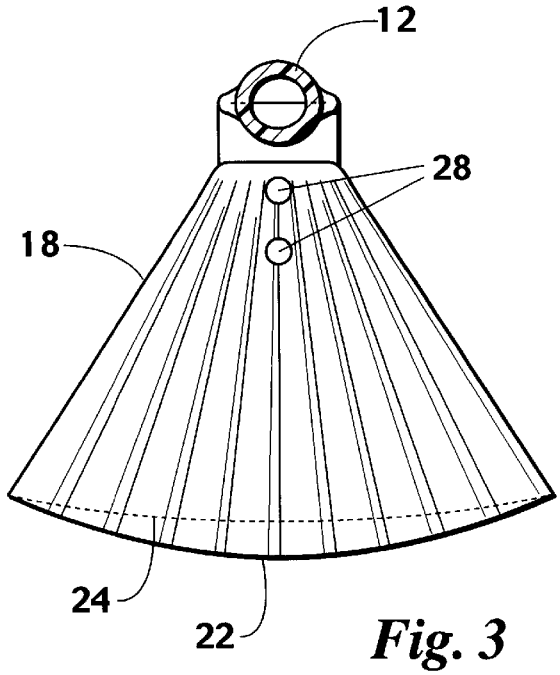
FIG. 3 is a sectional view taken along section line 3—3 of FIG. 2.

The soap compartment 16 (see now FIGS. 2, 3 and 5) is comprised of an upper horizontal plate 18 and a lower flat horizontal plate 20. As shown in FIG. 3, the plates 18 and 20 (not shown in FIG. 3) extend divergently outward from the shaft 12 in a somewhat fan-like shape. The outer-edge of the upper member 18 can be curved as at 22 in FIG. 3. Preferably, however, the forward edge 24 of the lower horizontal member 20 is straight and can be somewhat beveled, but not to the point where it would cut a person.

Figure 2:
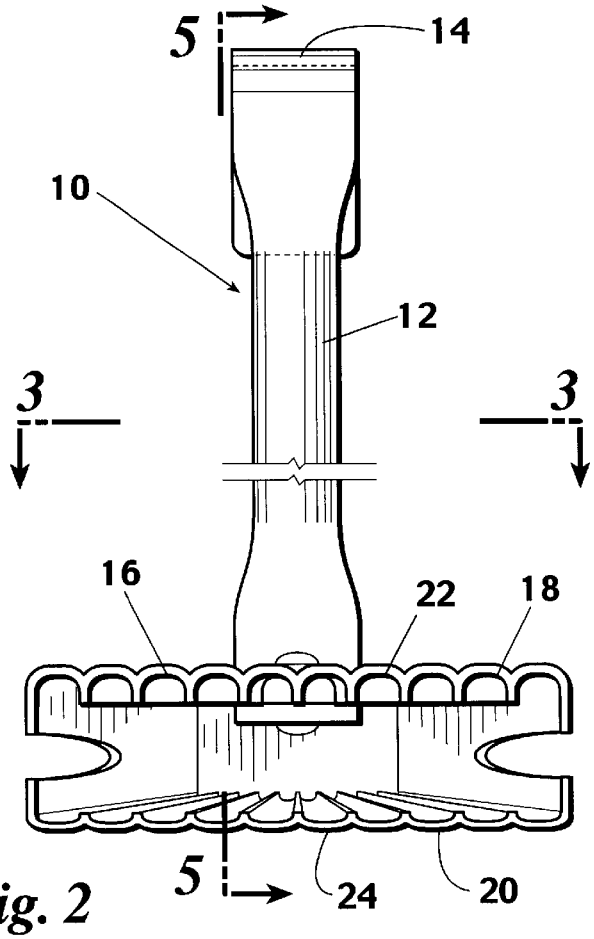
FIG. 2 is a front elevation of the soap retriever shown in FIG. 1 as viewed along line 2—2 of FIG. 1 and showing the cane shaft as broken.
Figures 4, 5:
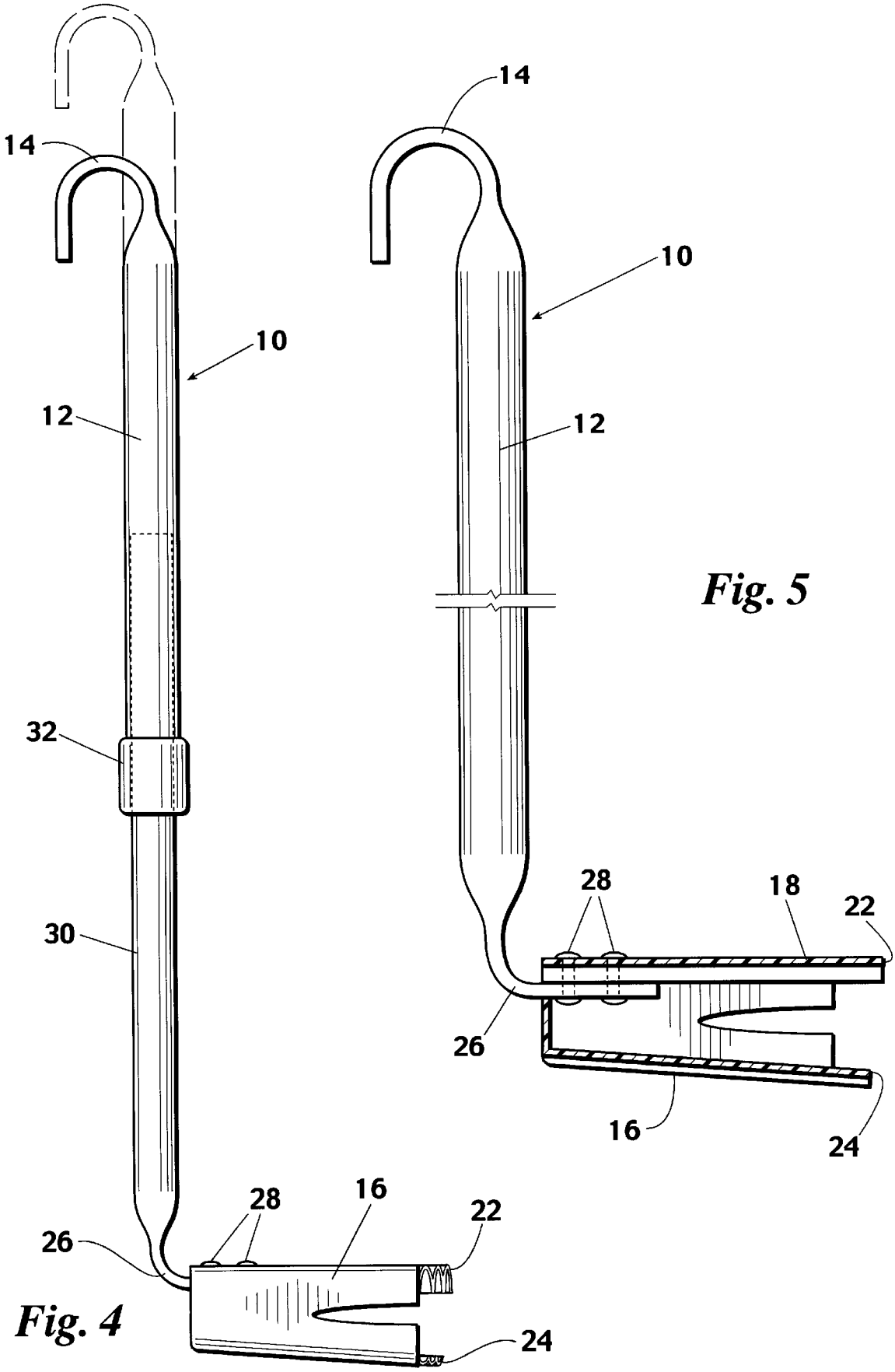
FIG. 4 is a side elevation of a modified form of the present invention wherein the cane shaft is subdivided into two relatively telescopic members which permit lengthening or shortening of the cane shaft.
FIG. 5 is a sectional view taken along section line 5—5 of FIG. 2 and showing internal details of the soap compartment.

As is best shown in FIGS. 1, 2 and 5, the lower end of the shaft 12 is flattened and bent at right angles as at 26. This flattened portion 26, which constitutes a tang, is preferably connected to the lower surface of the upper plate 18 by means of bolts or rivets 28.

Referring now to FIG. 4, the cane shaft 12 of the retriever 10 shows a modification wherein a lower tubular section 30 can be received telescopically within the upper section of the cane shaft 12. A conventional telescopic connector 32 is mounted at the lower end of cane shaft 12 to engage the tubular member 30 or release it, as the case may be, to permit telescopic movement of the member 30 within the member 12 in a conventional manner. Thus, the device 10 of FIG. 4 is a longitudinally adjustable cane shaft 12 preferably for use with tall people.

Figure 6:
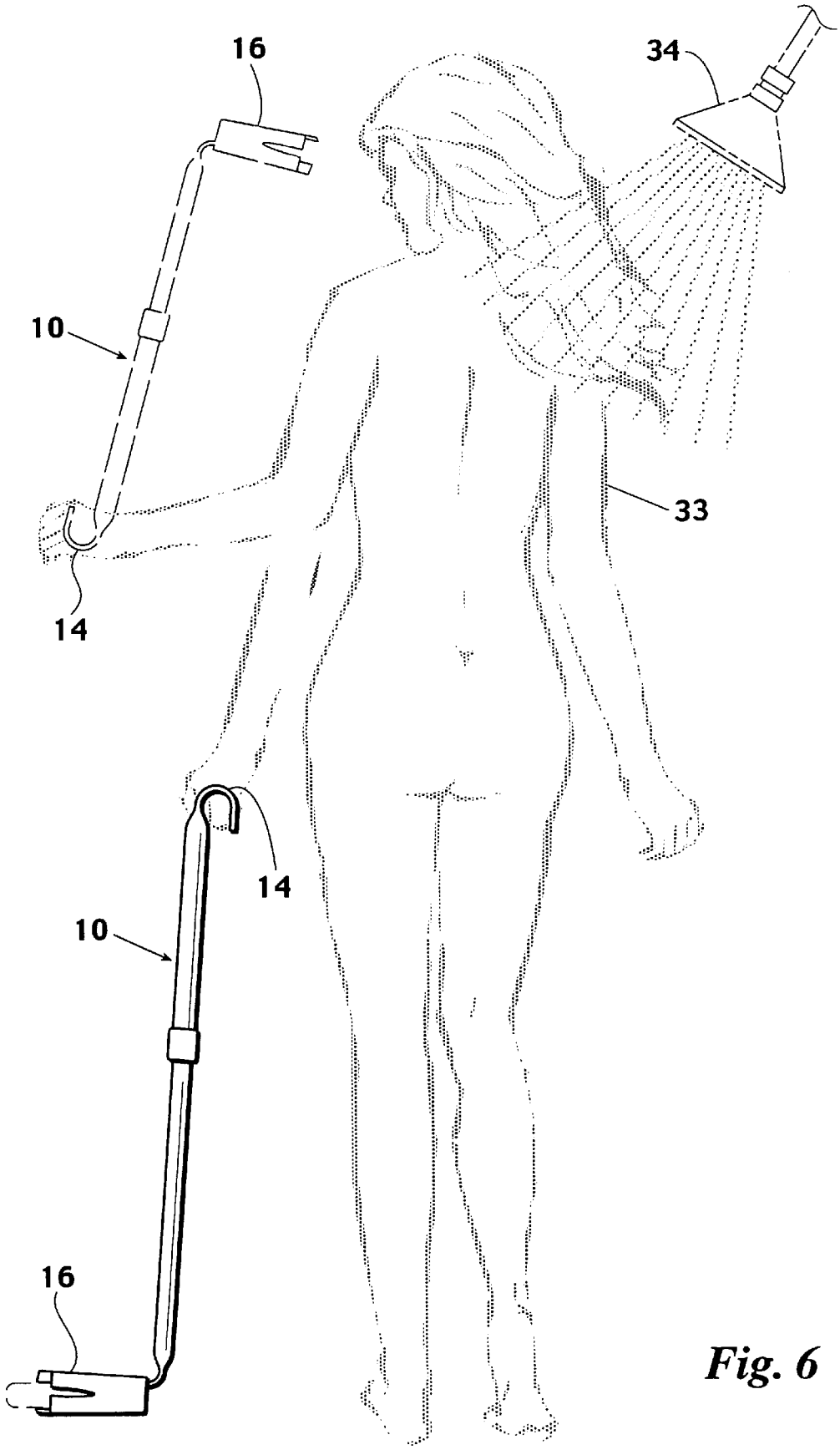
FIG. 6 is a view of a lady (in phantom) in a shower stall and showing the use of the device of the present invention to retrieve soap. The retrieving position of the device is shown in dotted lines, as is the shower head.

FIG. 6 shows a lady 33 in a shower environment which is represented only by a shower head 34 shown in dotted lines. One would expect the shower environment to be either a shower stall or a bathtub provided with such a shower head. The bathtub would normally have a shower curtain (not shown) supported on a shower curtain rod (not shown). The shower stall would normally have a closeable door(not shown) through which one would find ingress into the shower stall. The lady is shown grasping the soap retriever 10 of the present invention in her left hand and thereafter swinging and elevating the device 10 to where the soap compartment 16 is positioned for her to remove the soap therefrom with her right hand. Thereafter, the lady can hang the device 10 out of the way by hooking the hook 14 over the rod used for supporting the shower curtain. If the lady is in a shower stall, she can hook the soap retriever over the top edge (not shown) of the stall or door.

Whereas the present invention has been shown in particular relation to the drawings attached hereto, it should be understood that other and further modifications, apart from those shown or suggested herein, may be made within the spirit and scope of this invention.

What is claimed is:

1. A soap retriever for use in a shower stall comprising an elongated shaft having an upper end and a lower end, the shaft being comprised of a pair of relatively telescopic members which permit the shaft to be shortened or lengthened, a downwardly concave hook attached to the upper end of the shaft for hanging the soap retriever in the shower stall when not in use, a soap receiving compartment mounted at the lower end of the shaft, the soap compartment including a pair of vertically spaced horizontal plates, the horizontal plates consisting of an upper horizontal plate and a lower horizontal plate, the two plates extending divergently outwardly from the shaft in a fan-like shape and forming therebetween the compartment for receiving a bar of soap therein, the lower end of the shaft being bent at right angles and extending forwardly as a flattened portion, the flattened portion being attached to the upper horizontal plate, the lower horizontal plate having a forward edge which is essentially straight, the upper horizontal plate having an outer edge which is curved and disposed above the straight edge of the lower horizontal plate.

* * * * *